US006550157B1

(12) United States Patent
Harding

(10) Patent No.: US 6,550,157 B1
(45) Date of Patent: Apr. 22, 2003

(54) RECESSED DRYER VENT SYSTEM

(76) Inventor: Robert W. Harding, 1215 East 375 S., Springville, UT (US) 84663

( * ) Notice: Subject to any disclaimer, the term of this patent is extended or adjusted under 35 U.S.C. 154(b) by 0 days.

(21) Appl. No.: 10/035,971

(22) Filed: Nov. 9, 2001

(51) Int. Cl.[7] ..... F26B 5/06

(52) U.S. Cl. ..... 34/140; 34/235; 220/3.2; 220/3.3; 137/360

(58) Field of Search ..... 220/3.2, 3.3, 3.4, 220/3.5, 3.6, 3.7, 3.8, 3.9, 447; 137/360; 34/235, 595, 108, 140, 175, 606; 29/513; 285/64; 454/339

(56) References Cited

U.S. PATENT DOCUMENTS 2,930,505 A * 3/1960 Meyer ..... 220/18
3,495,276 A * 2/1970 Suess ..... 4/1
3,936,589 A * 2/1976 Teeters et al. ..... 174/65 R
4,434,564 A * 3/1984 Braggins ..... 34/86
4,890,396 A * 1/1990 King ..... 34/235
5,819,435 A * 10/1998 Tuggle ..... 34/235
5,970,623 A * 10/1999 Tuggle ..... 34/134
6,129,109 A * 10/2000 Humber ..... 137/360
6,378,227 B1 * 4/2002 Bradford ..... 34/235
6,419,102 B1 * 7/2002 Harpenau ..... 220/3.3

* cited by examiner

*Primary Examiner*—Ira S. Lazarus
*Assistant Examiner*—K. B. Rinehart
(74) *Attorney, Agent, or Firm*—Angus C. Fox, III

(57) ABSTRACT

A clothes dryer vent system is designed for hollow walls framed with scantling and covered with sheathing secured to the scantling, the walls having a hollow interior space that is uniformly, at least about 3½ inches wide. The vent system includes a rough-in box for recessed mounting within a hollow wall, the rough-in box having a substantially planar rear panel, side panels and nonparallel top and bottom panels, the side panels and the top and bottom panels intersecting and unitary with the rear panel, each side panel intersecting and unitary with both top and bottom panels, the rough-in box also having a depth no greater than about 4 inches, and a stub connector pipe affixed within the top panel, the stub connector pipe having a lower portion of oval-shaped cross section within the box that is couplable to a flexible dryer vent hose and an upper portion outside the box directly couplable to an oblong vent pipe having a minor cross-sectional dimension no greater than about 2 inches. The vent system also includes at least one section of 2-inch×7-inch oblong vent pipe interconnected between the rough-in box and an exterior vent.

20 Claims, 7 Drawing Sheets

100
101
102B
102L
102R
102T
103
104
105
106
107A
107B
107C
107D
108
201
202
203
204

500
506A
506B
507A
507B
502T
503
508A
508B
204
203
202

503
505
509B
502R
509D
204
201
202

801A
508A 508B
801B 500
503
505
509A
509B
508A
508B
508
502R
504
501
502L
502B
509C
509D

FIG. 36
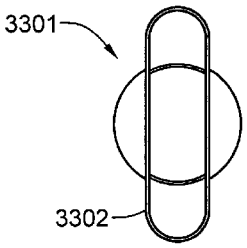
FIG. 35
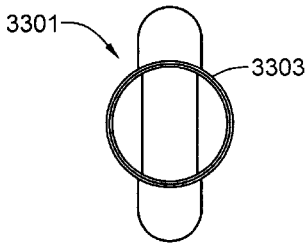
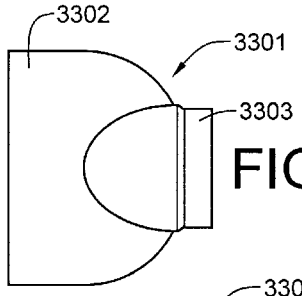
FIG. 34
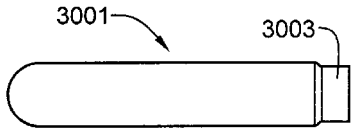
FIG. 32
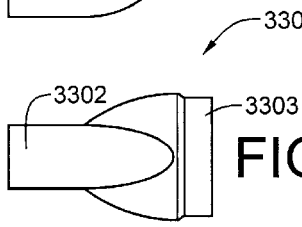
FIG. 33
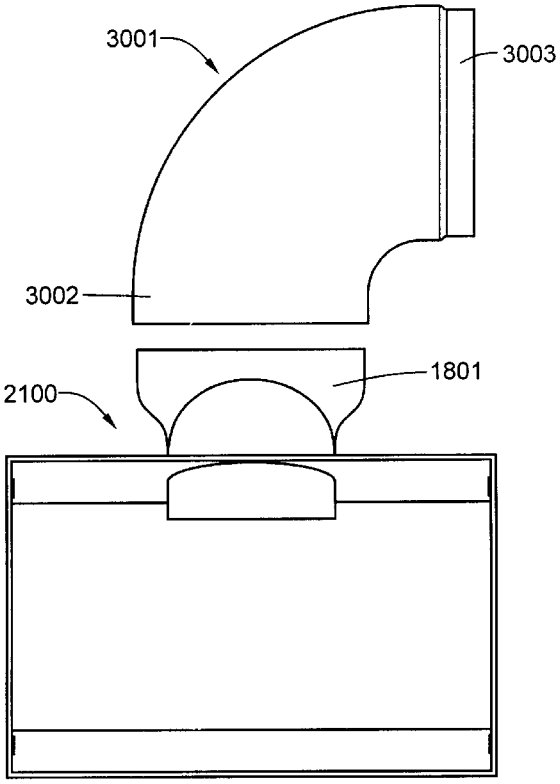
FIG. 30
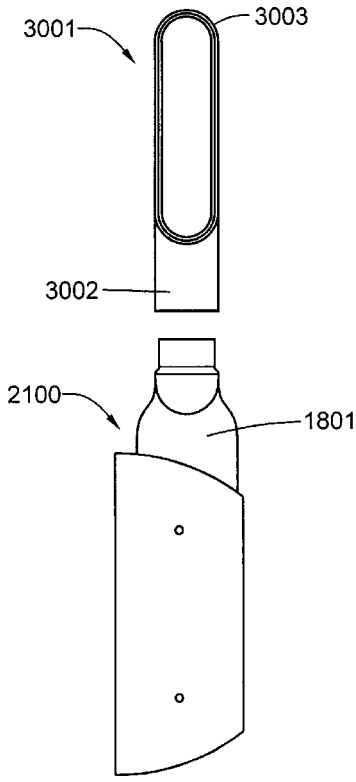
FIG. 31

RECESSED DRYER VENT SYSTEM

FIELD OF THE INVENTION

This invention relates, generally, to a recessed rough-in box for a dryer vent, to vent assemblies for use in combination with dryer vent rough-in boxes and, more particularly, to dryer vent rough-in boxes and vent assemblies which are designed to work effectively in hollow walls framed with 2×4 scantling lumber.

BACKGROUND OF THE INVENTION

In 1833, only a year after the city of Chicago began to rise from the treeless glacial plain adjacent lake Michigan, a carpenter from Connecticut named Augustine Deodat Taylor contracted to build a large number of houses in that Illinois city. Taylor responded by building what had become known as balloon frame houses. The walls, ceilings and roofs of a balloon frame structure are constructed from interconnected scantling frames which are subsequently covered. Though Taylor is frequently credited with the invention of the balloon frame structure, it seems that the construction technique emerged over several decades as a popular hybrid of many diverse building methods. In the historic Mississippi River town of Ste. Genevieve, Mo., the French were constructing houses, which still stand, using building methods which were precursors of the balloon frame method. Typically, the French constructed houses with palisade walls-vertical wooden posts placed side by side on 16-inch centers, with a continuous plate nailed across the top. Apparently, the walls were built flat on the ground, then tilted up within trenches dug along the perimeter of the building. Eventually, this palisade construction was modified so that the posts were nailed onto timber sills resting on stone or brick foundations. When standard-size lumber is substituted for the posts, the process is very close to the balloon construction method.

Light-weight, wood-frame houses have become the standard in this country. Because they are quite resistant to destruction in earthquake-prone regions, they are being adopted in faraway places, such as Japan, where killer earthquakes are common.

One of the distinguishing characteristics of wood-frame buildings is that the walls are generally hollow. The hollow walls facilitate the invisible routing of electrical, telecommunications and security system wiring, as well as gas and water pipes. Structural lumber used for nearly all interior walls, and for some exterior walls is typically 2×4 scantling having a generally rectangular cross section that measures about 3.8 cm by 8.9 cm (1.5 inches by 3.5 inches). The walls are typically covered with gypsum board sheets that are nailed or screwed to the framing material. For residential applications, the gypsum board sheets have a standard thickness of about 1.25 cm (½ inch). For commercial applications, the thickness of the gypsum board is about 1.59 cm (⅝ inch). Thus, the depth of a standard hollow interior wall, as constructed within the United States, is either 10.15 cm (4.0 inches) or 10.5 cm (4⅛ inches).

Within the past twenty years, it has become customary to install the drain and the hot and cold water taps for a washing machine in a recessed box that is coupled to the drain. Not only is space saved for washer installation, but any leaks from the taps flow into the drain. Clothes dryer vent installations have, as a rule, been notoriously sloppy. Not only has it been customary to terminate the vent pipe flush with the back wall, many builders install dryer vent pipes in 2×4 framed walls. As the width of a 2×4 stud is actually 3½ inches, 4-inch aluminum vent pipes are frequently compressed so that they are of oval cross section. The main problem with using a 4-inch vent pipe in a 2×4 framed is that it must pass through the top plate of the wall. It is nearly impossible to neatly compress an aluminum vent pipe so that will pass through the top plate and still leave a portion of the plate on either side of the pipe. A further problem is the frequent necessity of running the vent pipe between floor joists or trusses. If the vent pipe has been compressed to pass through a 2×4 top plate, there are no elbows available that will mate to a compressed 4-inch vent pipe and then, after the 90-degree bend, revert to 4-inch round pipe. These problems result in very sloppy installations of dryer vents in 2×4 framed walls. If an 90-degree elbow is required after the vent passes through a top plate of the same size, the quality of the installation is typically even worse.

Several U.S. patents have been granted for dryer vent assemblies. A first example is U.S. Pat. No. 5,590,477 to Carfagno, which discloses a dryer venting assembly having upper and lower mating rectangular housings, each of which has a protruding cylindrical flange with an opening into the housing to provide for the intake or exhaust of dryer exhaust gases. The Carfagno device appears to have two drawbacks. Firstly, neither of the housings provides a recess into which an accordioned flexible dryer conduit may be stored so that the dryer appliance may be positioned flush with the rear wall. Secondly, as the 90-degree transitions are not smooth, they will act as lint traps and also hamper the use of a vent-duct clean-out snake, which requires smooth transitions at right-angle junctions. A second example is U.S. Pat. No. 5,476,183 to Harpenau, which discloses a rectangular rough-in box for a dryer vent. This box, while providing room for an accordioned flexible dryer conduit, does not adequately address the problems inherent in installing a dryer vent in a 2×4 framed wall.

What is needed is an easily-installable, recessed rough-in box for terminating a clothes dryer vent, that will fit in hollow walls framed with either 2×4 or 2×6 scantling studs. Also needed is a set of vent pipes, for use in combination with the recessed box, that can fit within a 3½ inch wide cavity and pass through a top plate of the same width, without eliminating nearly all of the material in the top plate, make a smooth 90-degree bend to level, and transition to a 4-inch round vent pipe.

SUMMARY OF THE INVENTION

The present invention answers the heretofore expressed needs for an improved dryer vent system. According, a several embodiments of a clothes dryer vent system are provided. The vent system is designed for use in hollow walls that are framed with scantling and covered with sheathing secured to the scantling, and that have a hollow interior space that is uniformly at least about 3½ inches wide. The vent system includes a rough-in box for recessed mounting within such a hollow wall, the rough-in box having a substantially planar rear panel, side panels and nonparallel top and bottom panels. The side, top and bottom panels intersect and are unitary with the rear panel, with each side panel intersecting and unitary with both top and bottom panels. The rough-in box also has a depth no greater than about 4 inches, and a stub connector pipe affixed within said top panel, the stub connector pipe having a lower portion of oval-shaped cross section within the box that is couplable to a flexible dryer vent hose and an upper portion outside the box directly couplable to an oblong vent pipe having a minor cross-sectional dimension no greater than about 2 inches. The top panel of the rough-in box incorporates a stub A vent pipe so dimensioned has a cross sectional area of about 13 square inches, which is ½ square inch more than that of a 4-inch diameter vent pipe. Because the Uniform Building Code requires that vent pipe sections which are hidden in wall spaces be metal, this embodiment employs a metal vent pipe stub which transitions from an oval, designed to couple to a standard 4-inch flexible vent duct, to a 2-inch×7-inch connector. Also included in the vent system is at least one section of oblong vent pipe interconnected between the rough-in box and an exterior vent.

Several embodiments of the improved recessed rough-in box are provided, each of which has the attributes set forth above. The first embodiment thereof is designed for mounting between two parallel studs, and includes trimable support struts, each of which can be nailed to an adjacent stud. The first embodiment rough-in box also includes a vent stub connector pipe which passes through the top panel, the vent stub connector pipe having a lower oval configuration to fit a standard 4-inch diameter flexible vent hose that transitions outside the box to a low-profile 2-inch×7-inch connector. The low profile connector is a metal insert which is inserted within the oval portion of the vent stub connector pipe in order to provide compliance with the Uniform Building Code that requires that any dryer vent run outside the box must be either metal or metal lined. The first embodiment rough-in box is also equipped with a trim piece which mates with the box, and which conceals the rough edges of abutting gypsum board.

A second embodiment of the rough-in box is equipped with adjustable telescoping brackets so that the box may be easily installed between two parallel studs that are positioned at least 16 inches between centers. The telescoping brackets are equipped with a cleat at each end thereof. Like the first embodiment, the second embodiment rough-in box is also equipped with a trim piece which mates with the box, and which conceals the rough edges of abutting gypsum board. In order to provide clearance for the telescoping brackets, a metal stub vent pipe having a transition from an oval configuration to a low-profile 2-inch×7-inch configuration inside the box is used. The low-profile configuration continues as it passes through the top panel of the box, thereby providing a low-profile connector outside the box.

A third embodiment rough-in box is adapted for remodel construction. It incorporates multiple pop-up fasteners which enable the box to be inserted into a rectangular opening cut in gypsum board wall sheathing and secured within the opening. The third embodiment rough-in box has a built in trim flange, which conceals the rough edges of the rectangular opening in the sheathing. The stub vent pipe used for the third embodiment rough-in box is, preferably, identical to that used for the first embodiment box.

A fourth embodiment rough-in box is specifically designed for mounting between two adjacent framing studs positioned 16 inches between centers. As the box is slightly less than 14½ inches wide, it may be attached directly to each of the adjacent studs. This embodiment also includes a removable trim piece.

A fifth embodiment rough-in box is similar to the fourth embodiment box, but has a metal vent pipe connector that transitions from an oval shape within the box to a 2-inch× 7-inch vent pipe having semi-tubular end walls outside the box.

The first four embodiments are designed such that the basic box unit of each, including a lower portion of the stub vent pipe, may be manufactured as a single injection molded piece of polymeric plastic material. In order to ensure compliance with the Uniform Building Code, the stub vent pipe must be lined with sheet metal once it is outside the box.

Also included with the present invention is a set of vent pipes designed for use in either 2×4 or 2×6 framed walls. The pipe vent pipe is preferably of generally rectangular cross section with dimensions of 2 inches by 6 inches. A special elbow is designed to pass through a 2×4 top plate and still leave ¾ inch of material on either side of the pipe. The elbow transitions into a 4-inch round pipe for routing through floor joists to a termination external to the structure.

BRIEF DESCRIPTION OF THE DRAWINGS

FIG. 30 is a front elevational view of the rough-in box of FIGS. 18–20 and an elbow for 90-degree bends within a hollow wall;

FIG. 31 is a side elevational view of both the rough-in box of FIGS. 18–20 and the elbow first shown in FIG. 30;

FIG. 32 is a top view of the elbow shown in FIGS. 30 and 31;

FIG. 33 is a top plan view of a 2×6 -inch to 4-inch converter;

FIG. 34 is a side elevational view of the converter of FIG. 33;

FIG. 35 is a front elevational view of the converter of FIG. 33; and

FIG. 36 is a rear elevational view of the converter of FIG. 33.

PREFERRED EMBODIMENT OF THE INVENTION

The improved, recessed rough-in box for terminating a clothes dryer vent will now be described with reference to the attached drawing figures. It should be understood that the figures are not necessarily drawn to scale and are intended to be merely illustrative of the invention. Five embodiments of the improved dryer vent rough-in box will be described, as will be a vent duct system designed for use with the various embodiments of the rough-in box. All five embodiments of the improved dryer vent rough-in box are designed for installation within hollow walls framed with either 2×4 or 2×6 scantling studs.

Figures 1, 2, 3, 4:
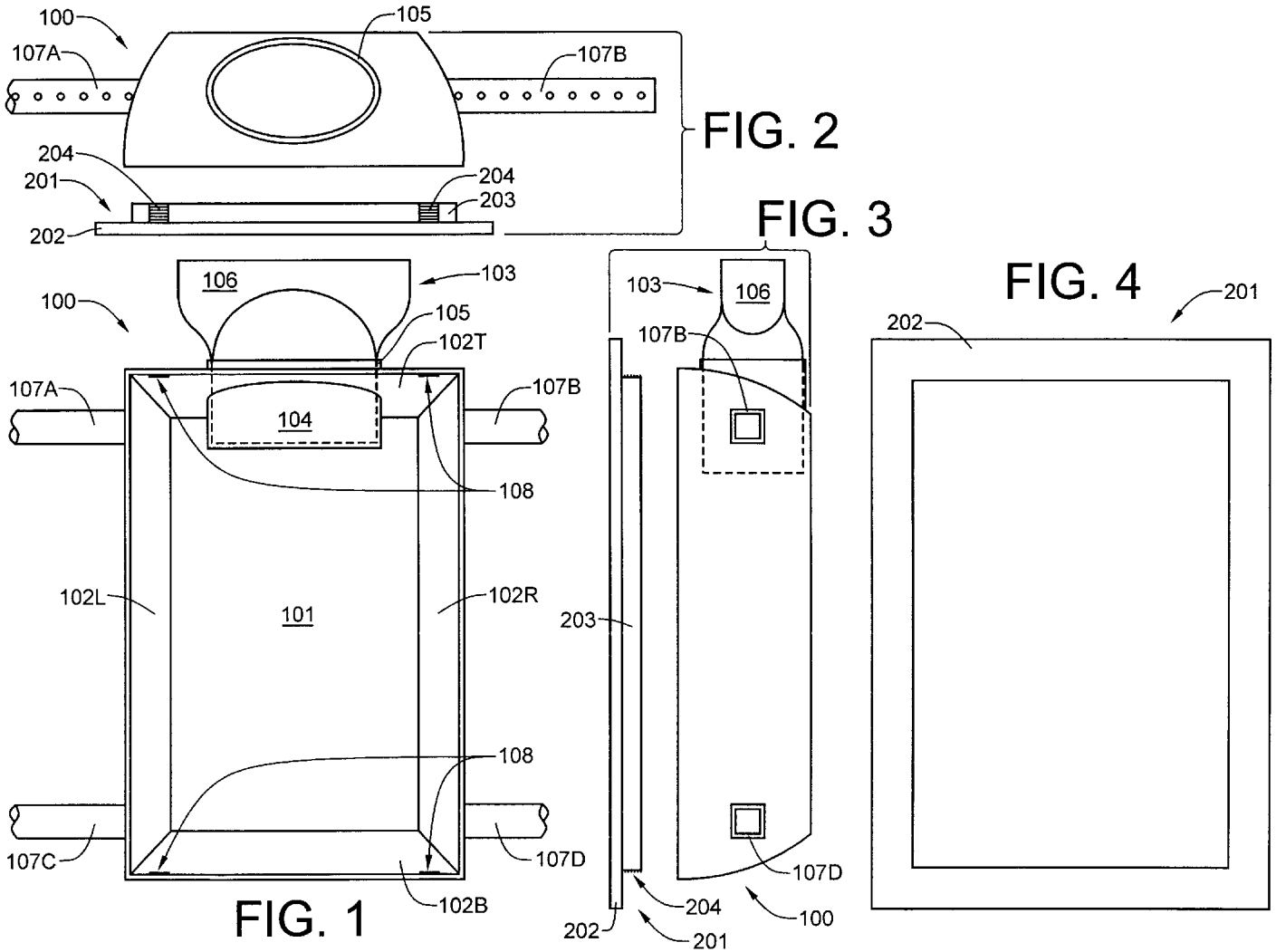
FIG. 1 is a front elevational view of a first embodiment of a rough-in box for a clothes dryer vent.
FIG. 2 is a top plan view of both the rough-in box of FIG. 1 and a trim piece which mates with that rough-in box.
FIG. 3 is a right-side elevational view of both the rough-in box of FIG. 1 and the trim piece first shown in FIG. 2.
FIG. 4 is a front elevational view of the trim piece first shown in FIG. 2.
Figure 22:
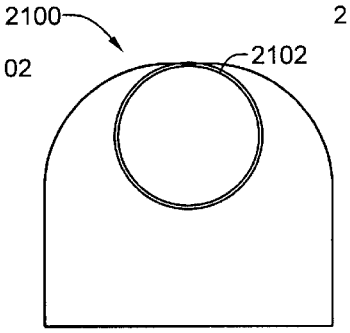
FIG. 22 is a front elevational view of the elbow of FIG. 21.
Figure 23:
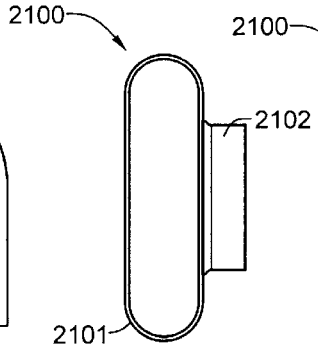
FIG. 23 is a bottom plan view of the elbow of FIG. 21.
Figure 24:
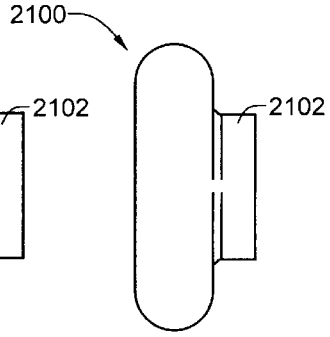
FIG. 24 is a top plan view of the elbow of FIG. 21.

Referring now to FIG. 1, a first embodiment dryer vent rough-in box 100 is designed for mounting between two parallel framing studs, and includes a planar rear panel 101 that is continuous with and intersected by a pair of curved side panels (102L and 102R) and curved top and bottom panels (102T and 102B, respectively). The top panel 102T incorporates an vent stub connector pipe 103. The vent stub connector pipe 103 is comprised of an oval portion 104 (inside the box) and 105 (outside the box) that is unitary with the top panel 102T. The vent stub connector pipe 103 also comprises a metal insert 106 that lines the oval portion 104. The insert 106 may be either adhesively bonded to the oval portion 104 and 105 or it may be taped to the oval portion 105 that extends outside the box 100. One end of a flexible 4-inch-diameter dryer vent hose may be directly attached to the oval lower portion 104 of the stub connector pipe 103, while the other end of the vent hose may be attached to the vent outlet on the clothes dryer, itself. The metal insert 106 may be mated to a low-profile vent pipe (see FIGS. 22 and 23) of generally oblong cross section that is designed to run within hollow walls. Each of four support struts 107A, 107B, 107C and 107D may be trimmed with a saw or knife to fit the space between two adjacent parallel wall-framing studs. The top and bottom panels 102T and 102B have a projecting ridge 109, which is used to attach the trim panel first shown in FIG. 2.

Referring now to FIG. 2, the top panel 102T is completely visible, as is the upper oval portion 105 of stub connector pipe 103 (the metal insert 106 has been removed in this view) and support struts 107A and 107B. Also shown is a trim panel 201 that is designed to clip to inner edges of the top panel 102T and the bottom panel 102B. The trim panel 201 has an outer frame 202 that is continuous with a rectangular flange 203. The flange 203 is equipped with multiple washboard clips 204 that mate with a the projecting ridge 108 on the top and bottom panels of rough-in box 100. It will be noted that each of the support struts 107A, 107B, 107C and 107D has multiple anchoring holes 205, by means of which the trimmed end of each support strut may be toenailed (obliquely nailed) into the wall-framing studs.

Referring now to FIG. 3, the right side panel 102R is completely visible, as are the upper oval portion 105 of the vent stub connector pipe 103 and the ends of the supports struts 107B and 107D. Also shown is the trim panel 201 first shown in FIG. 2. The profile of the washboard clips 204 is visible in this view.

Referring now to FIG. 4, it will be seen that the outer frame 202 of trim panel 201 is of rectangular shape.

Figures 5, 6, 7, 8, 9:
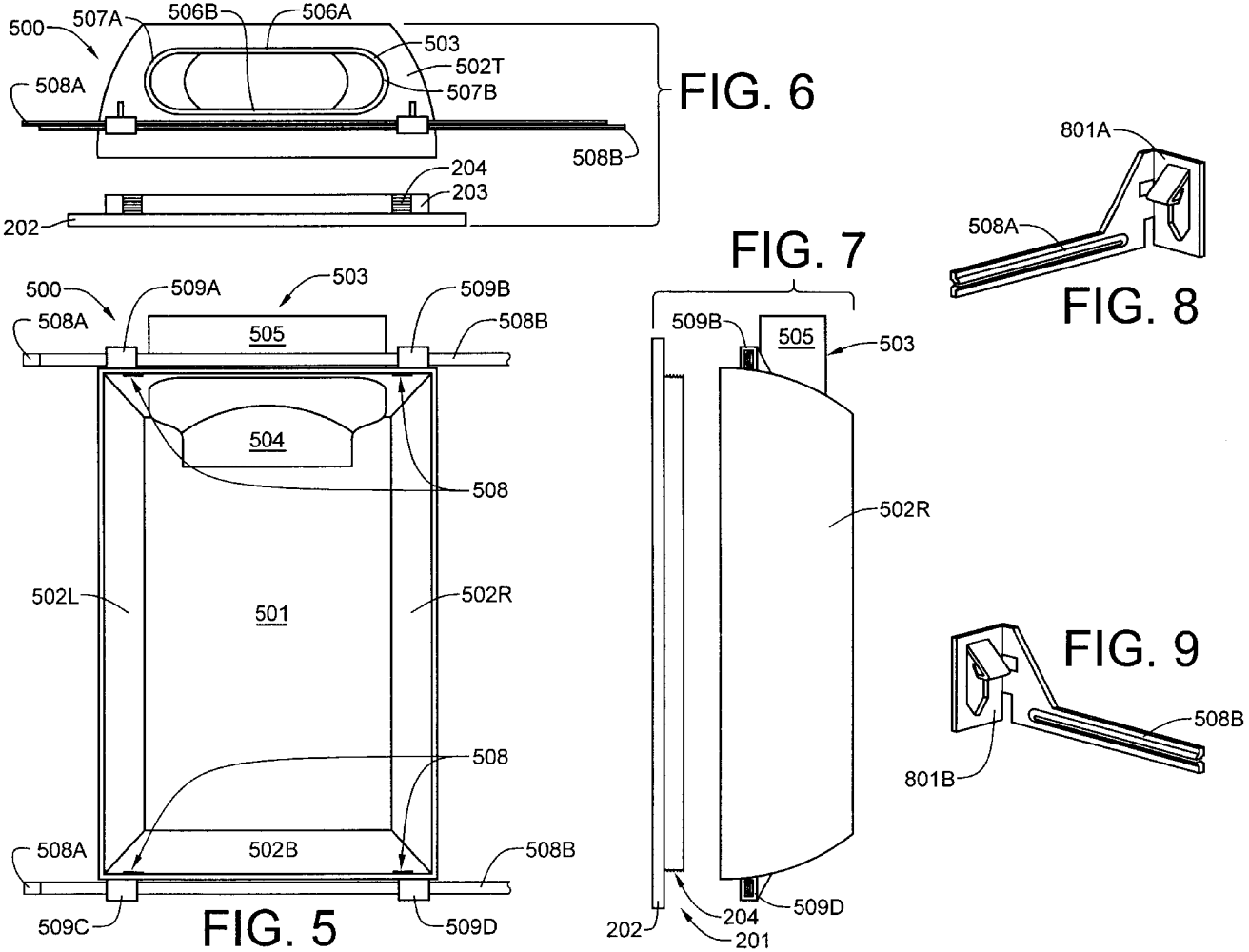
FIG. 5 is a front elevational view of a second embodiment of a rough-in box for a clothes dryer vent.
FIG. 6 is a top plan view of both the rough-in box of FIG. 5 and a trim piece which mates with that rough-in box.
FIG. 7 is a right-side elevational view of both the rough-in box of FIG. 5 and the trim piece first shown in FIG. 6.
FIG. 8 is an isometric view of the left end of a slidable mounting bracket.
FIG. 9 is an isometric view of the right end of a slidable mounting bracket.

Referring now to FIG. 5, a second embodiment rough-in box 500, like the first embodiment box 100 includes a planar rear panel 501 that is continuous with and intersected by a pair of curved side panels (502L and 502R) and curved top and bottom panels (502T and 502B, respectively). The top panel 502T, however, incorporates a vent stub connector pipe 503 fabricated entirely from sheet metal, and having an oval lower portion 504 which transitions to an upper portion 505 having parallel laminar walls 506A and 506B, which are interconnected at their edges by semi-tubular walls 507A and 507B. For ease of manufacture, the metal vent stub connector pipe 503 is bonded within an oblong hole in the top panel 502T. The low-profile oblong upper portion 505 not only provides a connector for oblong vent pipe, but also provides space in front of the stub connector pipe 503 for two sets of adjustable telescoping brackets, each of which comprises right and left members 508A and 508B, respectively. The upper telescoping bracket is secured to the top panel 502T with a first pair of tubular ears 509A and 509B. Likewise, the lower identical telescoping bracket is secured to the bottom panel 502B with a second pair of tubular ears 509C and 509D. The top and bottom panels 502T and 502B have a projecting ridge 508, which is used to attach the trim panel 201, first shown in FIG. 2.

Referring now to FIG. 6, the top panel 502T is completely visible, as is the stub connector pipe 503 and telescoping bracket 508A. Also shown is the trim panel 201 that is designed to clip to inner edges of the top panel 502T and the bottom panel 502B.

Referring now to FIG. 7, the right side panel 502R is completely visible, as are the upper portion 505 of the oval stub connector pipe 503 and the telescoping brackets 508A and 508B.

Referring now to FIGS. 8 and 9, each telescoping bracket, 508A or 508B, has a hammerable cleat 801 and 901, respectively, at the end thereof, by means of which the bracket may be anchored to a framing stud. As adjacent studs are typically installed 16 inch centers, the brackets 508A and 508B are designed to have a minimum width, including the cleat 801 or 901, of slightly less than 14½ inches, so as to fit between two such adjacent studs.

Figures 10, 11, 12, 13:
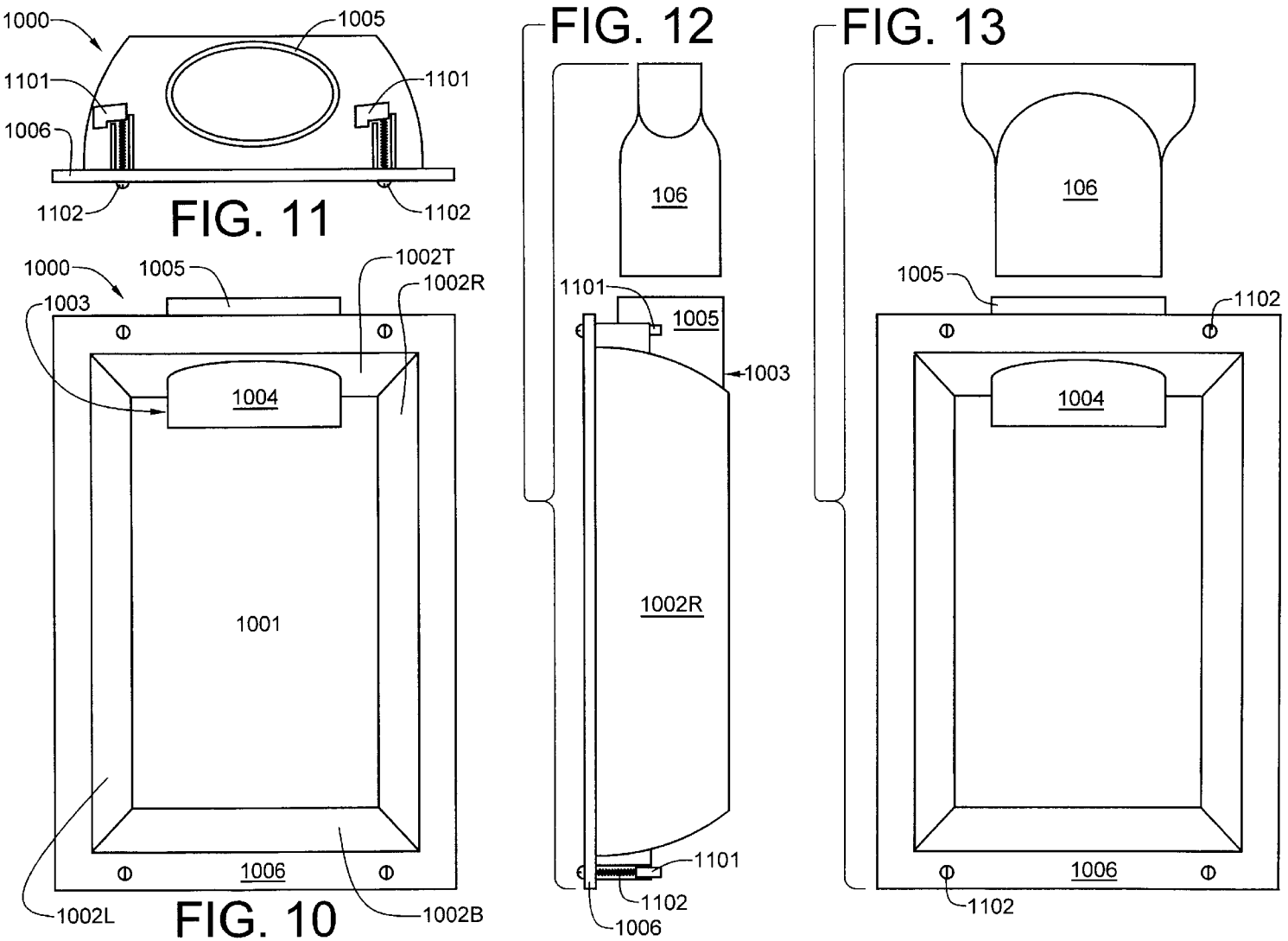
FIG. 10 is a front elevational view of a third embodiment of a rough-in box for a clothes dryer vent, this embodiment being adapted for remodel construction.
FIG. 11 is a top plan view of the rough-in box of FIG. 10.
FIG. 12 is a right-side elevational view of the rough-in box of FIG. 10 and an insert/coupler designed to bring the box into compliance with the Uniform Building Code.
FIG. 13 is a front elevational view of the rough-in box of FIG. 10 and the insert/coupler shown in FIG. 12.

Referring now to FIG. 10, a third embodiment rough-in box 1000 is adapted for remodel construction. Like the first and second embodiment boxes 100 and 500, respectively, it includes a planar rear panel 1001 that is continuous with and intersected by a pair of curved side panels (1002L and 1002R) and curved top and bottom panels (1002T and 1002B, respectively). The top panel 1002T incorporates an oval vent stub connector pipe 1003. However, unlike the first and second embodiment boxes, the third embodiment rough-in box 1000 has a trim flange 1004, that is continuous with the side panels 1002L, 1002R, 1002T and 1002B, and which is sized to conceal the rough edges of a rectangular opening, cut in the sheathing, into which the box 1000 is installed.

Referring now to FIG. 11, the third embodiment rough-in box 1000 also incorporates multiple pop-up fasteners 1101, which enable the box to be inserted into a rectangular opening cut in gypsum board wall sheathing and secured within the opening by tightening the screws 1102 on the face (see FIG. 10) of the trim flange 1004. Also visible in this drawing is the complete top panel 1002T and the stub connector pipe 1003.

Referring now to FIG. 12, the right side panel 1002R is completely visible, as is the upper portion 1005 of the stub connector pipe 1003, and one of the pop-up fasteners 1101 at the bottom of the box. Like the first embodiment shown in FIGS. 1 and 3, the third embodiment rough-in box requires a metal insert 106 to comply with the requirement of the Uniform Building Code that all unexposed dryer vent pipes must be either metal or metal lined. The insert/coupler 106, which has not yet been installed in this view, is preferably formed from aluminum sheet metal. The insert may be bonded within the oval lower portion 1010 of stub connector pipe 1003. The upper end of the insert/coupler/coupler 106 is shaped to fit a 2-inch×7-inch vent pipe. A vent pipe so dimensioned has a cross sectional area of about 13 square inches, which is ½ square inch more than that of a 4-inch diameter vent pipe. A vent pipe having these dimensions is ideal for runs within a 2×4 framed hollow wall, as it can pass through a 2-inch by 7-inch hole in the top plate of the framed wall and still leave about ¾-inch of framing material on either side of the vent pipe.

Referring now to FIG. 13, the third embodiment rough-in box 1100 is once again shown in a front view, but in combination with the insert/coupler 106, which has not yet been attached to the oval lower portion 1010.

Figure 14:
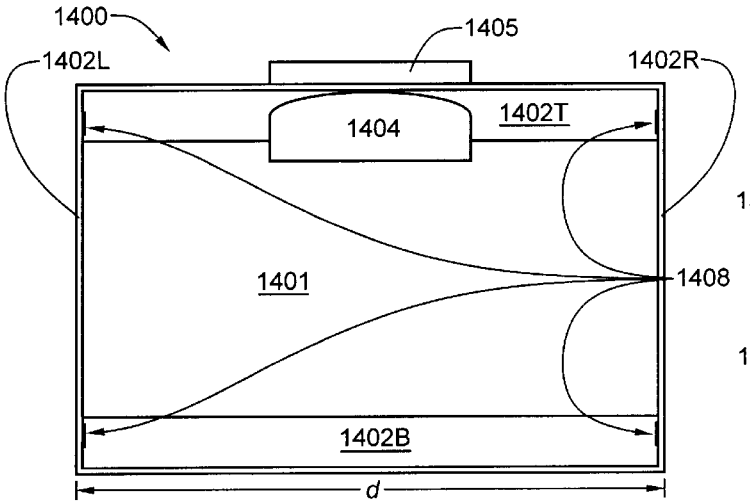
FIGS. 14 is a front elevational view of a fourth embodiment of a rough-in box for a clothes dryer vent.

Referring now to FIG. 14, a fourth embodiment rough-in box 1400 is specifically designed for mounting between two adjacent framing studs positioned 16 inches between centers. This particular embodiment has a planar rear panel 1401 that is continuous with and intersected by a pair of perpendicular side panels (1402L and 1402R, respectively) and curved top and bottom panels (1402T and 1402B, respectively). The top panel 1402T incorporates a lower and upper oval portions 1404 and 1405, respectively, of a vent stub connector pipe (not completely shown for this embodiment), which may be unitary with the rear, side, top and bottom panels, as formed by a single injection molding. Like the first and third embodiments of the rough-in box 100 and 1000 heretofore described, the fourth embodiment rough-in box 1400 requires a metal insert 106 to comply with the Uniform Building Code. The width dimension d of box 1400 is slightly less than 14½ inches wide, so that it may be attached directly to each of the adjacent studs with screws inserted through mounting apertures 1404. The side panels 1402L and 1402R have a projecting ridge 1408, which is used to attach the trim panel 1501 first shown in FIG. 15.

Figure 15:
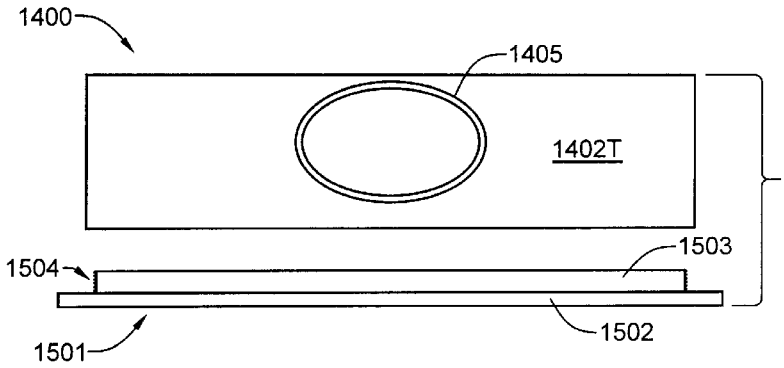
FIG. 15 is a top plan view of both the rough-in box of FIG. 14 and a trim piece which mates with that rough-in box.

Referring now to FIG. 15, the top panel 1402T is completely visible, as is the oval upper portion 1405 of the stub connector pipe. Also shown is a trim panel 1501 that is designed to clip to inner edges of the side panels 1402L and 1402R. The trim panel 1501 has an outer frame 1502 that is continuous with a rectangular flange 1503. The profile of washboard clips 1504, used to anchor the flange 1503 of trim panel 1501 to the side panels 1402L and 1402R.

Figure 16:
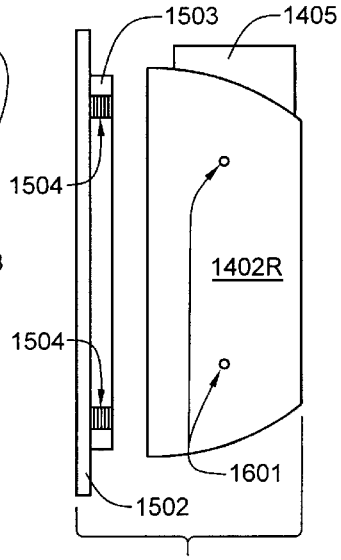
FIG. 16 is a right-side elevational view of both the rough-in box of FIG. 14 and the trim piece first shown in FIG. 15.

Referring now to FIG. 16, the right side panel 1402R is completely visible, as is an upper portion 1405 of the oval stub connector pipe 1403. The rectangular flange 1503 of the trim panel 1501 is equipped with multiple washboard clips 1601 that mate with a the projecting ridge 1408 on the side panels 1402L and 1402R of rough-in box 1400.

Figure 17:
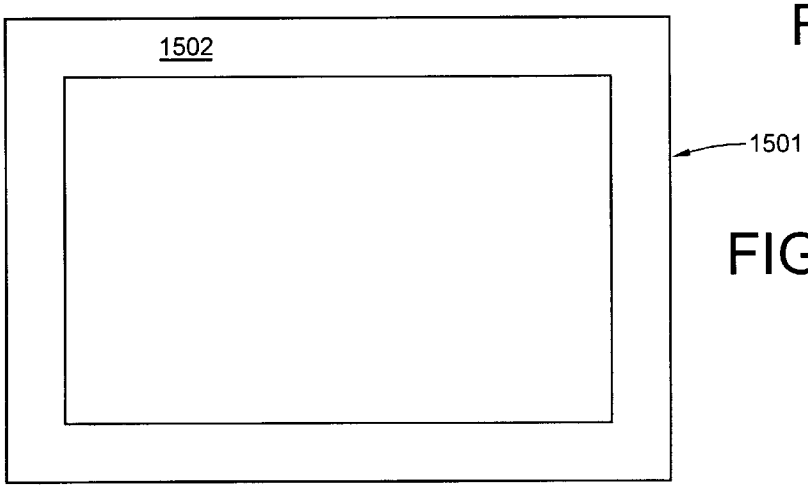
FIG. 17 is a front elevational view of the trim piece first shown in FIG. 15.

Referring now to FIG. 17, it will be seen that the outer frame 1502 of trim panel 1501 is of rectangular shape.

Figure 18:
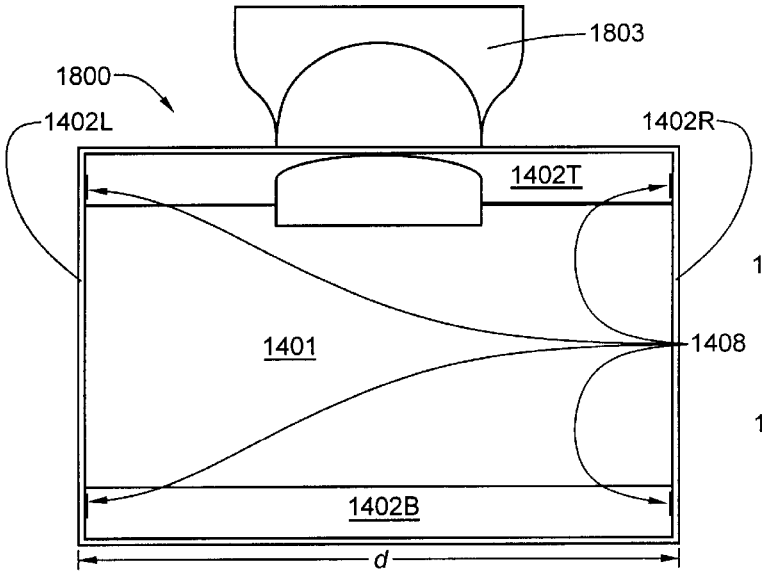
FIGS. 18 is a front elevational view of a fifth embodiment of a rough-in box for a clothes dryer vent.

Referring now to FIG. 18, a fifth embodiment rough-in box 1800 is identical to the fourth embodiment box 1400, with the exception being the makeup of the vent stub connector pipe 1803, which is entirely made of sheet metal and transitions from a lower oval portion 1804 within the box 1400 to an oblong 2-inch×7-inch portion 1805 outside the box. The most practical construction method for this embodiment is injection molding the box with an oval aperture in the top panel thereof, and then adhesively bonding or crimping the vent stub connector pipe 1803 within the oval aperture.

It should be evident that the fourth and fifth embodiment rough-in boxes 1400 and 1800, respectively, provide for maximum flexibility in positioning a dryer, as it need not be accurately positioned in order for a flexible dryer duct hose to connect to the exhaust port of a clothes dryer. That is, even if the clothes dryer is not positioned so that its hot-air exhaust port is aligned with the stub connector pipe 1403 or 1803 of the rough-in boxes 1400 or 1800, there is still a 10-inch-wide freedom of movement allowed for the flexible duct hose. Such a design facilitates positioning the clothes dryer flush with the wall in which the rough-in box is installed.

Figure 19:
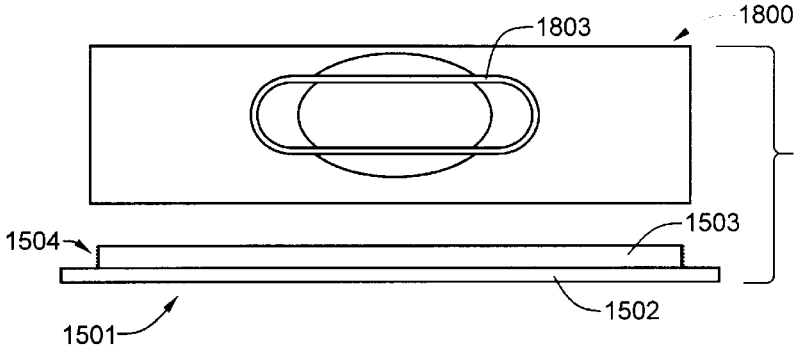
FIG. 19 is a top plan view of both the rough-in box of FIG. 18 and a trim piece which mates with that rough-in box, said trim piece having been first shown in FIG. 15.
Figure 20:
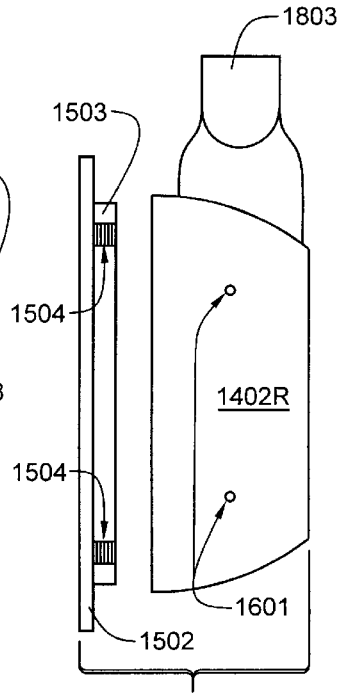
FIG. 20 is a right-side elevational view of both the rough-in box of FIG. 18 and the trim piece first shown in FIG. 15.
Figure 21:
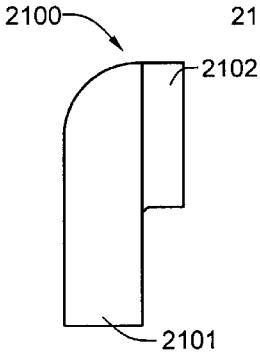
FIG. 21 is a side elevational view of a 90-degree elbow used to vent from a vertical rise in a wall to an exterior location adjacent the wall.

Referring now to FIGS. 19 and 20, the shape of the stub connector pipe 1803 is clearly shown, first in a top plan view, then in a side elevational view. An oval stub connector pipe configuration is used within the box because of the difficulty of securely coupling a flexible vent hose to the 2-inch×7-inch pipe.

The first four embodiments are designed such that the basic box unit of each, including the vent pipe stub, may be manufactured as a single injection molded piece of polymeric plastic material. In order to ensure compliance with the Uniform Building Code, the hidden portion of the injection molded vent pipe stub may be lined with a metal sheath designed to coupled to a either straight cut oval or rectangular vent pipe.

Referring now to FIGS. 21 through 24, a 90-degree "L" coupler 2100 transitions from a 2-inch×7-inch vent pipe to a 4-inch diameter round vent pipe. Such a coupler from a 2-inch×7-inch vent pipe 2101 to a 4-inch diameter round vent pipe 2102. Such a coupler may be used to couple a vertically or horizontally-oriented 2-inch×7-inch vent pipe to a perpendicular, horizontally-oriented 4-inch diameter round vent pipe. Such a coupler may be particularly useful for routing a 2-inch×7-inch dryer vent through an exterior wall and then making an abrupt transition to the exterior of the building. The "L" coupler 2100 is designed for ease of cleaning and minimal trapping of lint therein.

Figures 25, 26, 27, 28, 29:
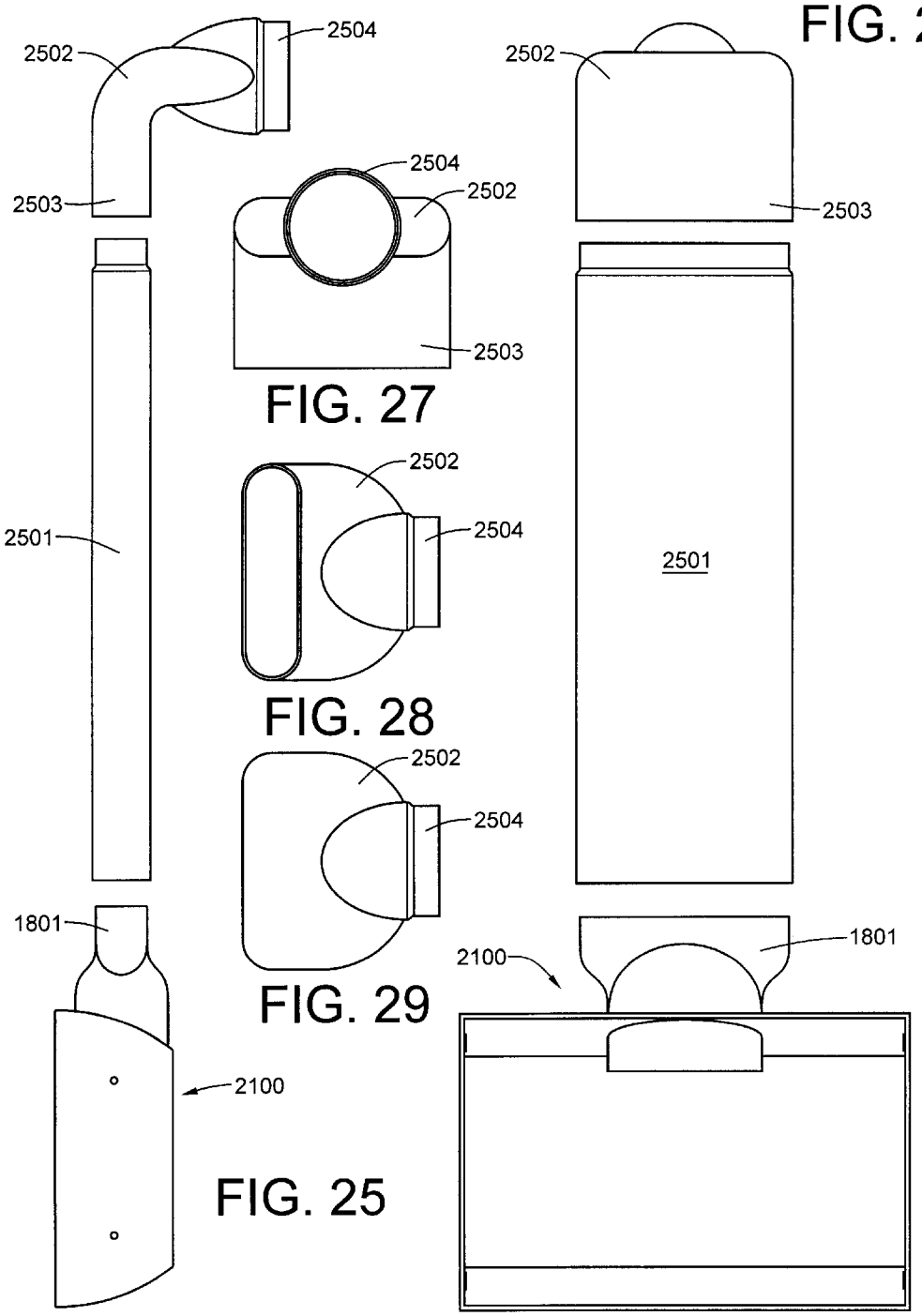
FIG. 25 is a side elevational view of both the rough-in box of FIGS. 18–20 and a vent pipe assembly to be used in combination therewith.
FIG. 26 is a front elevational view of the rough-in box of FIGS. 18–20 and the vent pipe assembly first shown in FIG. 25.
FIG. 27 is a rear elevational view of the gradual 90-degree elbow for exiting a hollow wall and adopting a horizontal orientation, shown in FIGS. 22 and 23.
FIG. 28 is a bottom plan view of the gradual 90-degree elbow shown in FIG. 24.
FIG. 29 is a top plan view of the gradual 90-degree elbow shown in FIGS. 24 and 25.

Referring now to FIGS. 25 and 26, a fifth embodiment rough-in box 1800 is shown aligned with a 2-inch×7-inch straight vent pipe 2501 and an 90-degree elbow/converter 2502. The elbow/converter 2502 is preferably formed from aluminum sheet metal, and is particularly useful for vertical-to-horizontal transitions above a header or plate, where the remainder of the vent run will be made with 4-inch diameter vent pipe. A first port 2503, on one side of the 90-degree bend, the elbow mates to a 2-inch×7-inch vent pipe, while a second port 2504 on the other side mates to a 4-inch round vent pipe. The elbow/converter 2502 is also shown in various views in FIGS. 27 through 29. The elbow/converter 2502 is also preferably formed from aluminum sheet metal. The elbow/converter 2502 is designed to pass through a 2×4 wall top plate and still leave ¾ inch of material on either side of the pipe. The elbow transitions into a 4-inch round pipe for routing through floor joists or ceiling joists to a termination external to the structure.

Referring now to FIGS. 30 and 31, a fifth embodiment rough-in box 1800 is shown aligned with a 90-degree elbow 3001, which is designed for bends completely within a 2×4 hollow wall. The 90-degree elbow 3001, which is also shown from above in FIG. 32 has a female port 3002 and a male port 3003.

Referring now to FIGS. 33 through 36, a straight converter 3301 transitions from a first port 3302 couplable to a 2-inch×7-inch vent pipe to a second port 3303 couplable 4-inch round vent pipe, once the vent pipe leaves a 2×4 framed wall.

Although only several embodiments of the improved recessed dryer vent rough-in box have been heretofore described, it will be obvious to those having ordinary skill in the art that changes and modifications may be made thereto without departing from the scope and the spirit of the invention as hereinafter claimed.

What is claimed is:

1. A clothes dryer vent system for hollow walls framed with scantling and covered with sheathing secured to the scantling, said walls having a hollow interior space that is uniformly, at least about 3½ inches wide, said vent system comprising:

a rough-in box for recessed mounting within a hollow wall, said rough-in box having a substantially planar rear panel, side panels and nonparallel top and bottom panels, said side panels and said top and bottom panels intersecting and unitary with the rear panel, each side panel intersecting and unitary with both top and bottom panels, said rough-in box also having a depth no greater than about 4 inches, and a stub connector pipe affixed within said top panel, said stub connector pipe having a lower portion of oval-shaped cross section within the box that is couplable to a flexible dryer vent hose and an upper portion outside the box directly couplable to an oblong vent pipe having a minor cross-sectional dimension no greater than about 2 inches; and at least one section of oblong vent pipe interconnected between the rough-in box and an exterior vent.

2. The clothes dryer vent system of claim 1, wherein said side panels are parallel and spaced such that the rough-in box has a width of about 14½ inches, which is a standard distance between two vertical and mutually parallel framing studs positioned on 16-inch centers.

3. The clothes dryer vent system of claim 1, wherein said rough-in box further comprises a first adjustable telescoping mounting affixed to said top panel, and a second adjustable telescoping mounting bracket affixed to said bottom panel, each telescoping mounting bracket positioned parallel to said rear panel.

4. The clothes dryer vent system of claim 1, wherein said rough-in box further comprises multiple support struts affixed to each of the side panels, said struts being trimmable to fit a space between two adjacent parallel wall-framing studs.

5. The clothes dryer vent system of claim 1, wherein said rough-in box further comprises:

an outwardly-extending rectangular trim flange that is continuous with the side and top and bottom panels; and multiple pop-up fasteners, each of which is attached to one of the panels other than the rear panel, each of which is tightenable with a threaded fastener accessible on an outward face of the trim flange, each of said fasteners cooperating with the trim flange to anchor the rough-in box to edges of wall sheathing into which has been cut a rectangular aperture for receipt of the rough-in box.

6. The clothes dryer vent system of claim 1, wherein said upper portion is formed from sheet metal and secured within the lower portion of the stub connector pipe, said metal upper portion extending through said top panel.

7. The clothes dryer vent system of claim 1, where said oblong vent pipe has a major cross-sectional dimension of about 7 inches and a minor cross-sectional dimension of about 2 inches.

8. The clothes dryer vent system of claim 1, wherein said oblong vent pipe comprises a pair of opposed planar walls which are continuous with a pair of opposed, semi-tubular walls.

9. The clothes dryer vent system of claim 1, which further comprises a right-angle elbow having male and female oblong connectors and a total width of no more than 2 inches.

10. The clothes dryer vent system of claim 1, which further comprises a right-angle elbow having both a round 4-inch connector and an oblong connector having a minor cross-sectional dimension of no greater than 2 inches.

11. The clothes dryer vent system of claim 1, which further comprises a vent fitting coupled to the upper portion selected from the group consisting of:

a right-angle elbow having male and female oblong connectors and a total width of no more than 2 inches;

a right-angle elbow having both a round 4-inch connector and an oblong connector having a minor cross-sectional dimension of no greater than 2 inches;

a straight through coupling having both a round 4-inch connector and an oblong connector having a minor cross-sectional dimension of no greater than 2 inches; and a 90-degree "L" coupler having an oblong connector and a round 4-inch connector, said 4-inch connector opening into one of the pair of parallel planar walls of the oblong connector thereby accomplishing a change in the cross-sectional shape of the vent pipe from oblong to round and a complete right-angle change of direction within a two-inch-wide space.

12. A clothes dryer vent rough-in box for hollow walls framed with scantling and covered with sheathing secured to the scantling, said walls having a hollow interior space that is uniformly, at least about 3½ inches wide, said rough-in box comprising:

a substantially planar rear panel;

nonparallel top and bottom panels, said top and bottom panels intersecting and unitary with said rear panel;

a pair of side panels, each side panel intersecting said rear panel and said top and bottom panels, each side panel being continuous and unitary with other panels which each side panel intersects, said rear, top, bottom, and side panels together forming a box-like structure having a depth no greater than about 4 inches;

a stub connector pipe affixed within said top panel, said stub connector pipe having a lower portion of oval-shaped cross section positioned within the box that is couplable to a flexible dryer vent hose and an upper portion outside the box directly couplable to an oblong vent pipe having a minor cross-sectional dimension no greater than about 2 inches.

13. The clothes dryer vent rough-in box of claim 12, wherein said side panels are parallel and spaced such that the rough-in box has a width of about 14½ inches, which is a standard distance between two vertical and mutually parallel framing studs positioned on 16-inch centers.

14. The clothes dryer vent rough-in box of claim 12, wherein said rough-in box further comprises a first adjustable telescoping mounting affixed to said top panel, and a second adjustable telescoping mounting bracket affixed to said bottom panel, each telescoping mount bracket positioned parallel to said rear panel.

15. The clothes dryer vent rough-in box of claim 12, wherein said rough-in box further comprises multiple support struts affixed to each of the side panels, said struts being trimmable to fit a space between two adjacent parallel wall-framing studs.

16. The clothes dryer vent rough-in box of claim 12, wherein said rough-in box further comprises:

an outwardly-extending rectangular trim flange that is continuous with the side and top and bottom panels; and multiple pop-up fasteners, each of which is attached to one of the panels other than the rear panel, each of which is tightenable with a threaded fastener accessible on an outward face of the trim flange, each of said fasteners cooperating with the trim flange to anchor the rough-in box to edges of wall sheathing into which has been cut a rectangular aperture for receipt of the rough-in box.

17. The clothes dryer vent rough-in box of claim 12, wherein said upper portion is formed from sheet metal and secured within the lower portion of the stub connector pipe, said metal upper portion extending through said top panel.

18. The clothes dryer vent rough-in box of claim 12, where said oblong vent pipe has a major cross-sectional dimension of about 7 inches and a minor cross-sectional dimension of about 2 inches.

19. The clothes dryer vent rough-in box of claim 18, wherein said oblong vent pipe comprises a pair of opposed planar walls which are continuous with a pair of opposed, semi-tubular walls.

20. In combination with the clothes dryer vent rough-in box of claim 1, a vent pipe coupled to the upper portion of said stub connector pipe, said vent pipe selected from the group consisting of:

a right-angle elbow having male and female oblong connectors and a total width of no more than 2 inches;

a right-angle elbow having both a round 4-inch connector and an oblong connector having a minor cross-sectional dimension of no greater than 2 inches;

a straight through coupling having both a round 4-inch connector and an oblong connector having a minor cross-sectional dimension of no greater than 2 inches; and a 90-degree "L" coupler having an oblong connector and a round 4-inch connector, said 4-inch connector opening into one of the pair of parallel planar walls of the oblong connector thereby accomplishing a change in the cross-sectional shape of the vent pipe from oblong to round and a complete right-angle change of direction within a two-inch-wide space.

* * * * *